United States Patent [19]

Sonoda et al.

[11] Patent Number: 4,874,480

[45] Date of Patent: Oct. 17, 1989

[54] PROCESS FOR TREATMENT OF TITANIUM AND TITANIUM ALLOYS

[75] Inventors: Sakae Sonoda; Kouji Hetsugi; Yoshihiko Sawasaki; Kouji Kaburagi; Yasunobu Matsushima, all of Kanagawa, Japan

[73] Assignee: Henkel Corporation, Ambler, Pa.

[21] Appl. No.: 184,548

[22] Filed: Apr. 20, 1988

[30] Foreign Application Priority Data

Apr. 20, 1987 [JP] Japan ..... 62-97216

[51] Int. Cl.[4] ..... C25D 11/36

[52] U.S. Cl. ..... 204/56.1; 204/38.1; 204/56.1; 72/41; 72/46

[58] Field of Search ..... 204/56.1, 38.1, 35.1, 204/29, 43.1

[56] References Cited

U.S. PATENT DOCUMENTS 4,639,295 1/1987 Miyamotu et al. ..... 204/56.1

*Primary Examiner*—John F. Niebling
*Assistant Examiner*—David G. Ryser
*Attorney, Agent, or Firm*—Ernie E. Szoke; Wayne C. Jaeschke; Norvell E. Wisdom

[57] ABSTRACT

A method of producing titanium and titanium alloys having improved lubricity and cold working characteristics includes immersing titanium or titanium alloy as the cathode in an electrolytic conversion coating bath containing acidified zinc phosphate and forming a zinc phosphate coating on the titanium or titanium alloy by maintaining electrolysis conditions in the bath. Further improvements are achieved by pretreatment of the titanium or titanium alloy with a surface adjustment agent prior to immersion in the electrolytic conversion coating bath. The products are further treated with conventional lubricants and exhibit improved working characteristics.

19 Claims, No Drawings

PROCESS FOR TREATMENT OF TITANIUM AND TITANIUM ALLOYS

BACKGROUND OF THE INVENTION

1. Field of the Invention

The present invention rlates to a process for improving the lubricity of titanium and titanium alloys. More particularly, the invention relates to a process for facilitating working of such materials, preventing seizure during cold working and producing products with excellent surface finish.

2. Statement of Related Art

In cold working of metal, use is generally made of a lubricant to impart lubricity, so as to prevent seizure, i.e., to prevent direct contact of a tool and material being worked. In the case of steel, for example, oil containing an extreme pressure agent is used in comparatively light working and a soap or solid lubricant in addition to a phosphate or oxalate is used in heavy working.

As with cold working of steel, there are various ways of working titanium and titanium alloys. More specifically, there is drawing of pipes, drawing of wires, header processing and cold rolling of sheets. Unfortunately, at the present time there is no satisfactory lubricant that is suited to the various working processes in the case of titanium and titanium alloys. In the drawing of titanium pipes, use has been made of methods in which scale formed in annealing serves as an under-film and an oily lubricant is used on top. Various resins in combination with oily film used on top of a resin film have been employed; and for the conversion coating, it is fluoride alone that has been tried.

In the case of cold rolling of titanium sheets, the liability of the material to seizure and the great work hardening that occurs mean that it is not possible to effect rolling with large diameter rolls. A Sendzimir mill is used with small diameter rolls such as is generally employed for stainless steel. Normally, a mineral oil-based neat oil or emulsion is used in a Sendzimir mill in order to prevent chattering. In header processing, as with other working processes, a variety of ways of improving lubricity have been considered but no practical method is commercially available.

Comparatively good lubricity has been displayed with fluoride films jointly used with soap lubricant on top of it. However, it is difficult to maintain long-term stable characteristics since the processing solution has an extremely short life. Furthermore, in the case of those titanium alloys which have particularly good resistance to corrosion it is not possible to form a film even if a fluoride is used.

In cold rolling of titanium or titanium alloy sheets, productivity is very poor even with small diameter rolls since seizure is likely to occur. There is no choice but to roll material and achieve a low draft of 15% or less per pass. Methods of heating to produce a thin oxide film in order to resolve such problems have been considered but they have not been found to be satisfactory. When fluoride-based conversion films (as noted above) are used, excellent effects have been achieved with respect to seizure, however, there is a serious drawback in connection with the short life of the processing solution.

An object of the present invention is to resolve these problems and provide a process for improving lubricity even when heavy working is effected in cold working of titanium or titanium alloys such that there is no seizure or breakage. A further object is to provide improved lubricity that is stable with elapse of processing time.

DESCRIPTION OF THE INVENTION

Other than in the operating examples, or where otherwise indicated, all numbers expressing quantities of ingredients or reaction conditions used herein are to be understood as modified in all instances by the term "about".

These and other objects are achieved in accordance with the present invention by providing a process which comprises immersing titanium or titanium alloys as the cathode in an electrolytic conversion coating solution containing an acidic zinc phosphate and maintaining electrolysis conditions to form an adherent zinc phosphate film thereon.

The acidic zinc phosphate electrolytic conversion coating solution used in this invention is an aqueous solution in which zinc phosphate is a critical component. The zinc ion concentration is maintained between 1 to 50 g/l, and preferably 5 to 20 g/l; and the phosphate ion concentration (as $PO_4^{\equiv}$) is maintained between 3 to 140 g/l, and preferably 10 to 60 g/l. Calcium, manganese and iron ions can be added to the bath as well as zinc ions, and it is possible to form a composite film of zinc and such materials.

It is further possible to use oxidizing agents such as nitric acid, sodium nitrate, hydrogen peroxide or ammonium persulfate, and the like or inorganic or organic depolarizers such as sodium m-nitrobenzenesulfonate or paranitrophenol, and the like in the acidic zinc phosphate conversion coating solution.

The pH used in the practice of this invention is maintained on the acid side and is adjusted so that it is preferably 1.0 to 5.0 and most preferably 1.5 to 3.5. Adjustment of the pH is effected by means of caustic soda, sodium carbonate, ammonia or similar bases. A temperature of 30° to 80° C., preferably 40° to 60° C., is used as the processing bath temperature. In the cathodic electrolysis of titanium or titanium alloys, the treated material is made the cathode and preferably zinc is used as the anode. Other suitable anodes include carbon, platinum, and stainless steel, for example.

The interelectrode distance in electrolysis and the current density and the electrolysis time must be adjusted in accordance with the desired film characteristics. Suitable interelectrode distances include between 5 to 30 cm, current densities between 0.2 to 30 $A/dm^2$, and preferably between 0.5 to 5 $A/dm^2$, and electrolysis times between 10 seconds to 5 minutes. If the current density is too high or the electrolysis time is too long, the result is blackening of the formed film or deterioration of adhesivity.

The coverage of the zinc phosphate film thus produced is between 2 to 20 $g/m^2$. These films are preferably used in conjunction with added lubricant on top to give desired slip properties. Materials employable as lubricants are known materials such as fatty acid sodium soap, oils and fats, mineral oils, solid lubricants, and the like.

In one preferred embodiment of the present process for improving lubricity, the titanium or titanium alloys are first treated with a colloidal titanium-based surface adjustment agent prior to immersing these materials in an acidic zinc phosphate conversion coating solution and effecting cathodic electrolysis.

Conventionally, titanium colloid surface adjustment agents are employed as the colloidal titanium-based surface adjustment agent in conjunction with the present invention. Colloidal aqueous solutions which contain between 10 to 200 ppm of titanium ions, 200 to 3000 ppm of phosphate ions and 30 to 600 ppm of pyrophosphate ions are preferred. Various substances may be emplooyed as the necessary ion supply sources in this surface adjustment agent. Examples include titanium sulfate, titanyl sulfate or titanium oxide for titanium ions, phosphate or an alkali metal salt or ammonium salt of phosphoric acid for phosphate ions and pyrophosphate or an alkali metal salt or ammonium salt of pyrophosphoric acid for pyrophosphate ions. Surface adjustment agents can be prepared by mixing the above-noted component donor sources with water and heating, then removing the water component, mixing the residue uniformly with an amount of sodium carbonate, or the like, to give a desired pH value and dissolving this mixture in a suitable amount of water. A surface adjustment agent is material which causes a titanium compound colloid to adhere to the surface of titanium or a titanium alloy and so improves conversion coating characteristics and gives a good film. If the titanium ion concentration is lower than a set value, conversion coating characteristics are poor, while if it is higher than a set value better practical effects are not achieved. Phosphate ions also have the same function. Phosphate ions have the effect of giving good conversion coating characteristics, but this effect is not observed if the concentration of these ions is lower than a set value. Subsequent formation of a good conversion coating film is hindered if the pH of the surface adjustment agent is lower than a set value and is also hindered if the pH is too high.

Immersion of the titanium or alloy in the surface adjustment solution is followed by removal and immediate immersion as the cathode in an acidic zinc phosphate electrolytic conversion coating solution containing acidic zinc phosphate and maintaining electrolysis conditions to form a zinc phosphate film thereon. The composition of the acidic zinc phosphate processing solution, the treatment conditions and the cathodic electrolysis conditions are the same as described above. As in the case described earlier, a known lubricant must be applied on the film thus formed.

In the case of steel, a zinc phosphate film can be formed readily simply by immersion in an acidic zinc phosphate conversion coating solution. In the case of titanium and titanium alloys etching by phosphoric acid does not progress and it is difficult to form a zinc phosphate films since the surface of these materials is covered by a tough oxide film.

The reaction in an acidic zinc phosphate chemiforming processing solution can be represented by the following formulae:

$$Me + 2H^+ \rightarrow Me^{2+} + H_2\uparrow \quad (1)$$

Me: metal $$3Zn(H_2PO_4)_2 \rightarrow Zn_3(PO_4)_2 + 4H_3PO_4 \quad (2)$$

When reaction (1) takes place and the pH increases near the metal surface, reaction (2) occurs and a tertiary phosphoric acid salt of the metal is deposited and adheres, so forming a film on the metal's surface. In summary, it is not possible to form a film unless reaction (1) takes place.

In the case of titanium and titanium alloys, reaction (1) does not take place and so a film cannot be formed. Reaction (2) is brought about electrically if one effects cathodic electrolysis. That is, $$2H^+ + 2e \rightarrow H_2\uparrow \quad (1)$$

and as a result the pH in the vicinity of the surface increases and reaction (2) takes place. In summary, a zinc phosphate film can be formed on the surface of titanim or a titanium alloy according to the present invention even though it is not etched. Another aspect is that since there are also zinc ions present in the conversion coating solution, cathodic electrolysis also results in deposition of some metallic zinc.

The mechanism of the action on immersion in an aqueous solution of the colloidal titanium based surface adjustment agent is described hereinafter. The titanium or titanium alloy has colloidal titanium adhering to its surface when it is withdrawn following immersion in the solutions. Generally when zinc phosphate is deposited on occurrence of reaction (2), it is deposited first on the cathode portion of the metal surface and constitutes nuclei on which there is gradual growth. If the initially-produced nuclei are small, the formed film becomes thick and is in a coarse, porous state.

In accordance with this aspect of the invention, colloidal titanium adhering to the titanium or titanium alloy provides a large number of nuclei for deposition of zinc phosphate from the conversion coating solution thereby a fine, thin film that adheres well to the substrate.

When a zinc phosphate film is formed on titanium or a titanium alloy by cathodic electrolysis in accordance with this invention, since no etching takes place, there is no eluted metal present in the conversion solution. Consequently, hardly any aging of the conversion coating solution takes place. Control of the conversion coating solution is maintained over long periods of time as there is no formation of sludge produced by eluted metal.

EXAMPLES

Example 1

A cleaned 100 mm×50 mm×0.8 mm sheet of pure titanium (JIS Class 1) was treated with a conversion coating solution composition under the electrolytic conditions as noted below and then lubricant treatment was effected.

Aqueous conversion coating solution composition

| | |
|---|---|
| Zinc | 9.6 g/l |
| Phosphoric acid | 36.3 g/l |
| Nitric acid | 2 g/l |
| Sulfuric acid | 0.5 g/l |
| Nickel | 0.03 g/l |

The pH was adjusted to about 3.0 by means of sodium hydroxide.

Electrolysis conditions

| | |
|---|---|
| Anode | Zinc plate |
| Interelectrode distance | 15 cm |
| Current density | 3 A/dm$^2$ |
| Time | 1 minute |
| Temperature | 45° C. |

-continued

| | |
|---|---|
| Coating film weight | about 10 g/m$^2$ |

Lubricant treatment

Treatment of the treated titanium was effected under the following conditions using Palube 235 manufactured by Nihon Parkerizing. Palube 235 is a solution of 40 g/l sodium stearate and 3.5 g/l sodium nitrite in water.

Conditions

| | |
|---|---|
| Concentration | 70 g/l |
| Temperature | 75° C. |
| Time | 3 minutes |

Comparison Examples 2–4

For comparison, pure titanium sheets (as in Example 1) were used, and treatment was effected under the following conditions:

Example 2

A 10 u film was formed by treatment with 111QD which is a rubber-like resin manufactured by the Hangstaffer Company, and 10 g/m$^2$ of JI (manufactured by the Hangstaffer Company) which is an organic chlorine-containing compound as the main component which was used as a lubricant on top of this.

Example 3

10 g/m$^2$ of JI (manufactured by the Hangstaffer Company, organic chlorine-containing compound as main component) was used as a lubricant on top of scale produced by annealing in the atmosphere for 1 hour at 700° C.

Example 4

Treatment was effected under the following conditions using Palmet 3851 which is a neutral solution of sodium hydrogen difluoride, sodium nitrate, and manganese sulfate in water, with 13 g/l total fluoride ion, 1 g/l nitrate ion, and 1 g/l manganese ion.

Conditions

| | |
|---|---|
| Concentration | 24 g/l |
| Temperature | 60° C. |
| Weight of fluoride film | about 10 g/m$^2$ |
| Time | 2 minutes |

Example 4 further comprised lubricant treatment with Palube 235 under the same conditions as in Example 1.

Test methods for comparison of Example 1 with Examples 2–4

The samples from Examples 1–4 were tested under the following conditons using a Bowden tester (manufactured by the Toyo Baldwin Company, EFM-4 model).

| | |
|---|---|
| Load | 5 kg |
| Sliding width | 10 mm |
| Sliding speed | 10 mm/g |

-continued

| | |
|---|---|
| Temperature | normal |

Test results and evaluation

The number of times sliding to reach a coefficient of friction of 0.25 (seizure) and the coefficients of friction of rest of the samples were determined for the purpose of evaluation. The findings are shown in the following table (Table 1).

TABLE 1

| | Number of times sliding | Coefficient of friction |
|---|---|---|
| Example 1 | 515 | 0.103 |
| Comparison Examples 2 | 105 | 0.123 |
| Comparsion Examples 3 | 213 | 0.121 |
| comparison Examples 4 | 490 | 0.105 |

In Example 1 the number of times sliding to seizure was considerably greater than in the Comparison Examples and the coefficient of friction was low. Although Example 4 gives results which are close to those of Example 1, these are values that obtain when the processing solution is fresh. When the processing quantity exceeds 0.3 m$^2$/l the adhesivity of the film deteriorates badly and the film is no longer serviceable.

Example 5

Electrolytic conversion treatment was effected in the same way as in Example 1 using a 200 mm×20 mm×1.3 mm pure titanium sheet (JIS Class 1) but lubricant treatment with Palube 235 was not employed.

Comparison Examples 6–8

For comparison, treatment was effected under the following conditions using pure titanium sheets as in Example 5.

Example 6

Not treatment at all was effected.

Example 7

An approximately 2000 Å oxide film was formed by heating at 300° C.

Example 8

Treatment was effected under the following conditions using Palmet 3851 (manufactured by Nihon Parkerizing).

Conditions

| | |
|---|---|
| Concentration | 24 g/l |
| Temperature | 60° C. |
| Time | 2 minutes |

Test methods for Examples 5–8

Cold rolling tests were effected in the following conditions using a two-high butt rolling mill.

| | |
|---|---|
| (1) Coolant | |
| Rolling oil | Fine Roll 704-3 (manufactured by Nihon Parkerizing, mineral oil emulsion) |
| Concentration | 10% |

-continued

| | | | |
|---|---|---|---|
| | Temperature | 40° C. | |
| (2) | Rolling conditions | | |
| | Work rolls | 100 mm ϕ, #120 polish | |
| | Rolling speed | 10 m/min | |
| | Draft | Passes 1–3 20% each<br>Passes 4–6 10% each | target values when no treatment effected |

Test results and evaluation

Σ(%/T) was determined from the test results for each sample and findings are shown in the following table (Table 2). Σ(%/T) is used as an index of lubricity as defined below. Higher numbers indicate greater lubricity.

TABLE 2

| | | Σ(%/T) |
|---|---|---|
| | Example 5 | 206 |
| Comparison | Example 6 | 110 |
| Comparsion | Example 7 | 160 |
| Comparsion | Example 8 | 200 |

Where Σ(%) is the integrated value of draft (%)/rolling load (tons) per unit width in the different passes Example 5 is superior to Comparison Examples 6–8. In Comparison Example 6 in particular, this is a conventional process, and there is bad roll seizure and rollability because of the high draft. Comparison Example 8 gives a value close to that of the invention but this has not yet been brought into practical use.

Example 9

The conversion coating solution composition, the electrolysis conditions and the lubricant treatment were the same as in Example 1. In this Example, electrolysis was preceded by treatment with an aqueous solution of a colloidal titanium-based surface adjustment agent. The treatment conditions were 10 minutes immersion in a 3 g/l solution of Prepalene Z (manufactured by Nihon Parkerizing). which is a colloidal solution of titanium also containing phosphate and pyrophosphate ions.

Test Results and Evaluation

Testing was effected under the same conditions as in Example 1 using a Bowden tester. The test results for Example 9 and Example 1 are shown in the following table (Table 3).

TABLE 3

| | Number of times sliding | Coefficient of friction |
|---|---|---|
| Example 9 | 678 | 0.102 |
| Example 1 | 515 | 0.103 |

Seizure resistance is still better in Example 9 than it is in Example 1.

We claim:

1. A process for improving the lubricity and cold working characteristics of an object made of titanium or a titanium alloy, said process comprising:
   (a) immersing said object made of titanium or titanium alloy as a cathode in an electrolytic conversion coating solution containing an effective concentration of acidic zinc phosphate present as zinc and phosphoric acid ions;
   (b) maintaining electrolysis conditions to form an adherent zinc phosphate film on said object; and
   (c) treating said adherent zinc phosphate film with a lubricant.

2. The process of claim 1 in which the concentration of zinc ion is between about 1 and 50 grams per liter.

3. The process of claim 1 in which the concentration of zinc ion is between about 5 and 20 grams per liter.

4. The process of claim 1 in which the concentration of phosphate ion is between about 3 and 140 grams per liter.

5. The process of claim 1 in which the concentration of phosphate ion is between about 10 and 60 grams per liter.

6. The process of claim 1 containing at least one additional ion selected from the group consisting of calcium, manganese, and iron.

7. The process of claim 1 in which the conversion coating solution additionally contains an oxidizing agent.

8. The process of claim 1 in which said conversion coating solution has a pH between about 1 and 5.

9. The process of claim 1 in which said conversion coating solution has a pH between about 1.5 and 3.5.

10. The process of claim 1 in which the temperature of said conversion coating solution is maintained between about 30° and 80° C.

11. The process of claim 1 in which said electrolysis is effected employing a zinc anode.

12. The process of claim 1 in which the current density of said electrolysis at said cathode is between about 0.2 and 30 $A/dm^2$.

13. The process of claim 1 in which the electrolysis time is between about 10 seconds and 5 minutes.

14. The process of claim 1 in which the coverage of said adherent zinc phosphate film is between about 2 and 20 $g/m^2$.

15. A process for improving the lubricity and cold working characteristics of an object made of titanium or a titanium alloy, said process comprising:
   (a) treating said object made of titanium or titanium alloy with a colloidal titanium-based surface adjustment agent;
   (b) immersing said object made of titanium or titanium alloy as a cathode in an electrolytic conversion coating solution containing an effective concentration of acidiz zinc phosphate present as zinc and phosphoric acid ions;
   (c) maintaining electrolysis conditions to form an adherent zinc phosphate film on said object; and
   (d) treating said adherent zinc phosphate film with a lubricant.

16. The process of claim 15 in which said surface adjustment agent contains between about 10 and 200 ppm of titanium ions.

17. The process of claim 15 in which said surface adjustment agent additionally contains at least one of phosphate ions and pyrophosphate ions.

18. The process of claim 15 in which said treating of said object made of titanium or titanium alloy is by immersion in said surface adjusting agent, removal from said agent and immersion in said electrolytic conversion coating solution.

19. A process for improving the lubricity and cold working characteristics of an object made of titanium or a titanium alloy, said process comprising:
   (a) immersing said object made of titanium or titanium alloy as a cathode in an aqueous electrolytic conversion coating solution containing between about 1 and about 50 grams per liter of zinc ions, between about 3 and about 140 grams per liter of phosphoric acid ions and having a pH between about 1 and about 5;

(b) maintaining electrolysis conditions to form an adherent zinc phosphate film on said object made of titanium or titanium alloy; and (c) separating said object from soluton and further treating said zinc phosphate film with a lubricant.

* * * * *

UNITED STATES PATENT AND TRADEMARK OFFICE

CERTIFICATE OF CORRECTION

PATENT NO. : 4,874,480

DATED : October 17, 1989

INVENTOR(S) : Sakae Sonoda et al.

It is certified that error appears in the above-identified patent and that said Letters Patent is hereby corrected as shown below:

At Col. 8, line 47, claim 15, "acidiz" should read --acidic--.

Signed and Sealed this

Thirty-first Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,874,480

DATED : October 17, 1989

INVENTOR(S) : Sakae Sonoda et al

It is certified that error appears in the above-identified patent and that said Letters Patent is hereby corrected as shown below:

On the title page, at Item [73],"Assignee: Henkel Corporation, Ambler, PA." should read --Nihon Parkerizing Co., Ltd., Tokyo, Japan--.

Signed and Sealed this

Fifth Day of May, 1992

*Attest:*

DOUGLAS B. COMER

*Attesting Officer*

*Acting Commissioner of Patents and Trademarks*